US005197382A

United States Patent [19]

Goodwin

[11] Patent Number: 5,197,382

[45] Date of Patent: Mar. 30, 1993

[54] COPY SHEET PROOFING SYSTEM

[75] Inventor: Eber L. Goodwin, Arlington Heights, Ill.

[73] Assignee: AM International, Inc., Chicago, Ill.

[21] Appl. No.: 420,944

[22] Filed: Oct. 13, 1989

[51] Int. Cl.[5] ..... B41F 13/24; B41K 1/16

[52] U.S. Cl. ..... 101/72; 271/256; 101/2; 101/247; 101/232; 101/234

[58] Field of Search ..... 101/2, 232, 233, 234, 101/235, 236, 237, 238, 240, 72, 76, 246, 247, 279, 375, 409; 271/256, 258, 262, 287, 288, 289, 290, 300, 307, 308

[56] References Cited

U.S. PATENT DOCUMENTS

| | | | |
|---|---|---|---|
| 2,908,220 | 10/1959 | Eichenbaum et al. | 101/234 |
| 3,554,124 | 1/1971 | McIntire | 101/233 |
| 3,641,931 | 2/1972 | Hickox et al. | 101/2 |
| 3,763,775 | 10/1973 | Miles | 101/247 |
| 3,907,274 | 9/1975 | D'Amato et al. | 101/232 |
| 4,044,666 | 8/1977 | Doucet | 101/247 |
| 4,068,582 | 1/1978 | Poitras et al. | 101/247 |
| 4,181,078 | 1/1980 | Davis | 101/237 |
| 4,306,496 | 12/1981 | Charbonneau et al. | 101/247 |
| 4,614,867 | 9/1986 | Lane | 271/258 |
| 4,756,245 | 7/1988 | Roch | 101/234 |
| 4,905,985 | 3/1990 | Nagatani | 271/277 |

*Primary Examiner*—Edgar S. Burr

*Assistant Examiner*—Lynn D. Hendrickson

*Attorney, Agent, or Firm*—Wood, Phillips, VanSanten, Hoffman & Ertel

[57] ABSTRACT

A sheet proofing mechanism for a printing, duplicating and like machine wherein sheets are delivered seriatim by a conveyor in a path over a receiving tray whereat the sheets drop onto a stack of sheets in the tray. Releasable gripping fingers are provided on the conveyor, and stripping fingers strip each released sheet from the conveyor and direct the sheet into the tray. A sheet proofing mechanism includes deflecting fingers spaced along the path from the stripping fingers for deflecting a released sheet from the conveyor to a proofing station. A tripping cam is provided along the path for selectively releasing the gripping fingers at a first point to allow the stripping fingers to strip the released sheet from the conveyor and at a second point to allow the deflecting fingers to deflect the released sheet to the proofing station. The machine also includes a numbering head for sequentially numbering the sheets, with an indexing lever for indexing the numbering head. The proofing mechanism includes an interrupter for preventing operation of the indexing lever whereby a given sheet will not be sequentially numbered and such that the given sheet can be selectively deflected to the proofing station without interrupting the remaining order of sequential numbering.

3 Claims, 6 Drawing Sheets

FIG. 11
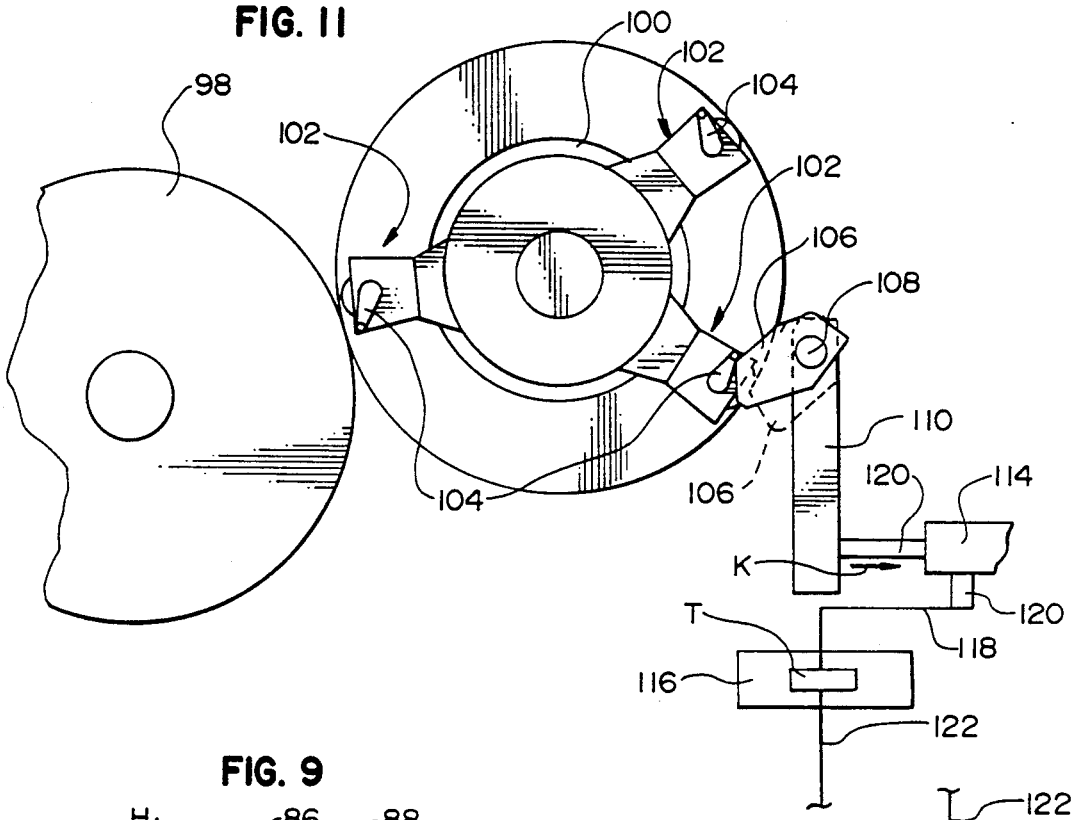
FIG. 9
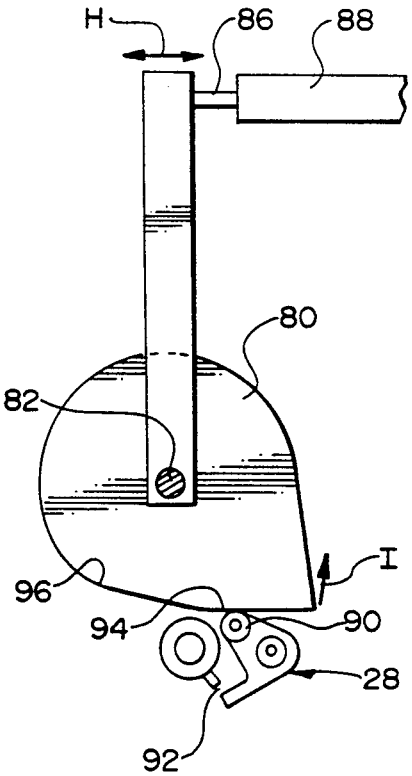
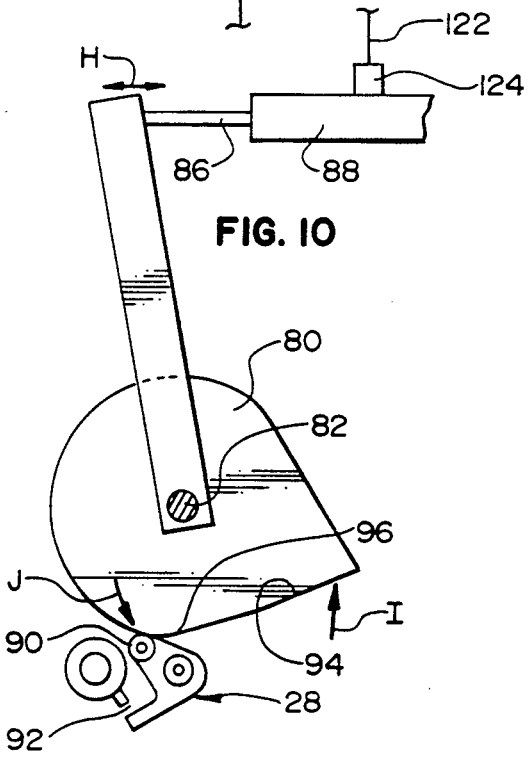
FIG. 10

COPY SHEET PROOFING SYSTEM

FIELD OF THE INVENTION

This invention generally relates to copy sheet handling mechanisms and, particularly, to a system for proofing copy sheets in a printing, duplicating and like machine.

BACKGROUND OF THE INVENTION

Printing, copying or duplicating machines, such as rotary offset lithographic duplicating machines, normally are provided with some form of sheet receiving means at the exit end of the machine for stacking copy sheets issuing from the machine. Conventionally, the sheet receiving means include a receiving tray for receiving and stacking the sheets as the sheets fall by gravity and come to rest onto the top of a stack in the tray.

Many such machines employ conveyor means for delivering the sheets seriatim in a path outwardly over the receiving tray. Conventionally, the conveyor means includes a rigid gripper bar extending transversely between a pair of generally parallel, endless drive chains. Such conveyor means commonly are called chain delivery devices. The gripper bar has gripper fingers which grasp the sheets issuing, from the machine and direct the sheets outwardly over the receiving tray whereat the gripper fingers are timed for release of the sheets at very high speeds. Upon release, the sheets have a tendency, due to momentum to continue in their path of directed travel. Stripper devices, usually including stripper fingers which are transversely spaced so that the gripper fingers can pass therebetween, are used for engaging the lead ends of the sheets as the sheets issue from the conveyor means, "stripping" the sheets from the conveyor means, and directing the sheets downwardly into the receiving tray.

In some instances, the machine has some form of proofing mechanism at the exit end of the machine near the receiving tray. These mechanisms are provided whereby one or more sheets can be diverted or taken out of the normal stacking procedure in order to proof the copy for quality or apparent problems. For instance, it has been known to position an interrupter plate into the stack of sheets for pulling a sheet out of the stack for proofing purposes and so that continuous delivery of the sheets onto the stack is not interrupted.

Proofing copy sheets becomes a considerable problem in machines which have finishing stations, particular where the sheets are sequentially numbered. A very common example is serially numbered bank checks or drafts. Of course, there are many other instances where it is desirable to number the copy sheets as they exit from the printing couple of the machine.

It can be understood that if a numbered copy sheet is removed from the normal delivery system, that numbered sheet must somehow get back into the stack in its proper place or order. This can be very time consuming and, with heavy stock paper or large size copy sheets, very cumbersome. Further, placing the proofed copy back into the stack most often disorients the stack and causes problems with further processing of the copy sheets.

This invention is directed to a novel system for proofing copy sheets exiting from a printing or duplicating machine, particularly in applications where the machine includes a sheet numbering system.

SUMMARY OF THE INVENTION

An object, therefore, of the invention is to provide a sheet proofing mechanism for use in a printing, duplicating and like machine wherein sheets are delivered seriatim by conveyor means in a path over a receiving tray or the like, whereat the sheets drop onto a stack of sheets in the tray, with releasable gripping means on the conveyor means and stripping means for stripping each released sheet from the conveyor means and directing the sheet into the tray.

Generally, the sheet proofing mechanism includes deflecting means spaced along the sheet path from the stripping means for deflecting a released sheet from the conveyor means to a proofing station. Tripping means are provided along the path operatively associated with the gripping means for selectively releasing the gripping means at a first point to allow the stripping means to strip a released sheet from the conveyor means and at a second point to allow the deflecting means to deflect a released sheet to the proofing station.

In the disclosed embodiment, the tripping means comprises a singular, selectively movable adjustable cam member having a first cam portion movable into position for engaging and tripping the gripping means at the first point along the sheet path, and a second cam portion movable into position for engaging and tripping the gripping means at the second point along the path. Specifically, the cam member is in the form of a rotatable plate having a peripheral surface whereby selective rotation of the cam plate brings first and second peripheral surface portions into and out of positions at the aforesaid first and second points for tripping the gripping means.

As stated above, the invention has particular applicability in machines which include a numbering head for sequentially numbering the copy sheets. Conventionally, such numbering heads have indexing means for indexing the head to present sequential number imprints. The invention contemplates that the proofing mechanism includes interruption means for preventing operation of the indexing means on the numbering head, whereby a given sheet will not be sequentially numbered and such that the given sheet can be selectively deflected to the proofing station by the tripping means without interrupting the remaining order of sequential numbering. Control means are provided for actuating the interruption means and the tripping means, preferably including time delay means for actuating the interruption means prior to actuating the tripping means. The time delay is for the purpose of allowing the given sheet time to move from the numbering head to the area of the receiving tray and tripping means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 9 is a somewhat schematic illustration of the tripping cam in position for tripping the gripper fingers at a first point along their path of movement;

FIG. 10 is a view similar to that of FIG. 9, with the cam rotated to trip the gripper fingers at a second point along their path of movement; and FIG. 11 is a somewhat schematic illustration of the interrupter means for preventing indexing of the numbering heads on the numbering drum.

DETAILED DESCRIPTION OF THE PREFERRED EMBODIMENT

Figure 1:
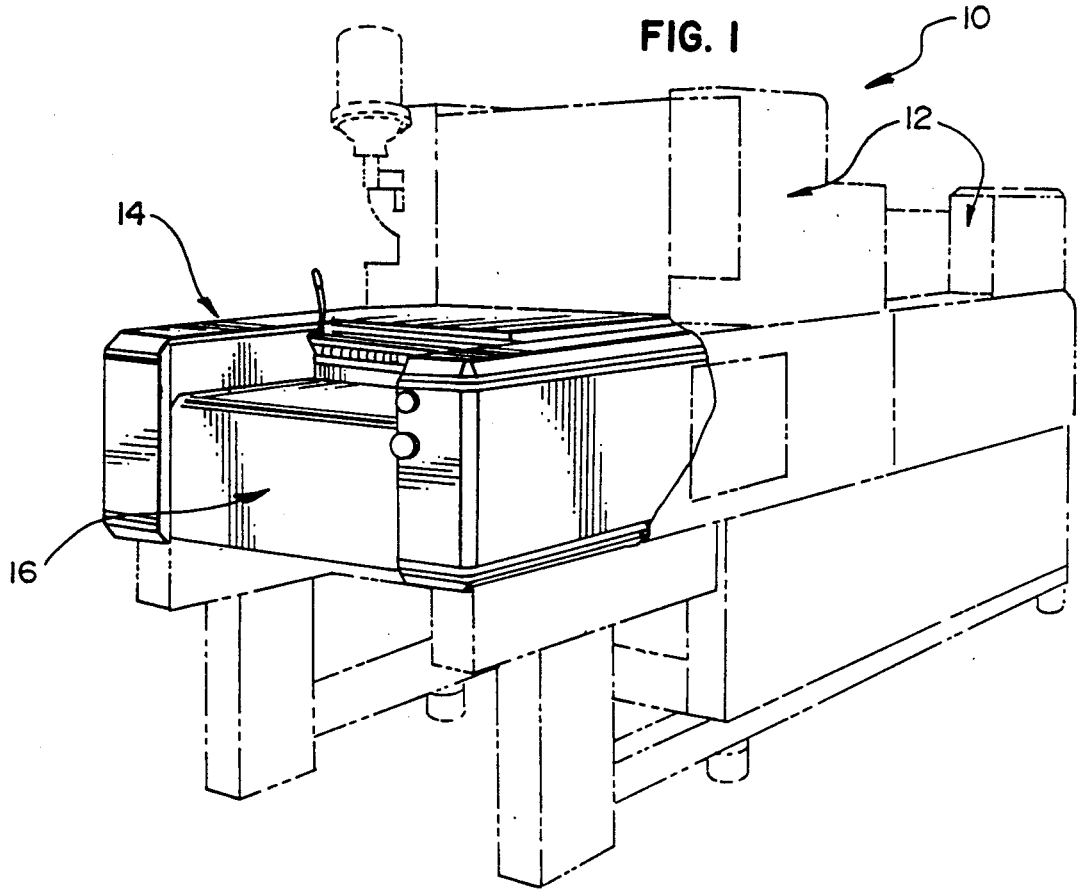
FIG. 1 is a schematic illustration of a printing machine in which the invention is applicable.

Referring to the drawings in greater detail, and first to FIG. 1, the invention is disclosed in conjunction with a printing, copying or duplicating machine, such as a rotary offset lithographic duplicating machine, generally designated 10, the majority of which is shown in phantom in FIG. 1. The machine may include one or more printing couples, located in areas of the machine generally designated 12. Copy sheets are delivered from the printing couple by appropriate conveyor means to some form of receiving means at an exit end, shown in full lines and generally designated 14, of the machine for stacking the copy sheets. Conventionally, the sheet receiving means is in the form of a receiving tray for receiving the sheets as the sheets fall by gravity and come to rest onto the top of a stack, generally in the area designated 16, in the tray.

Figure 2:
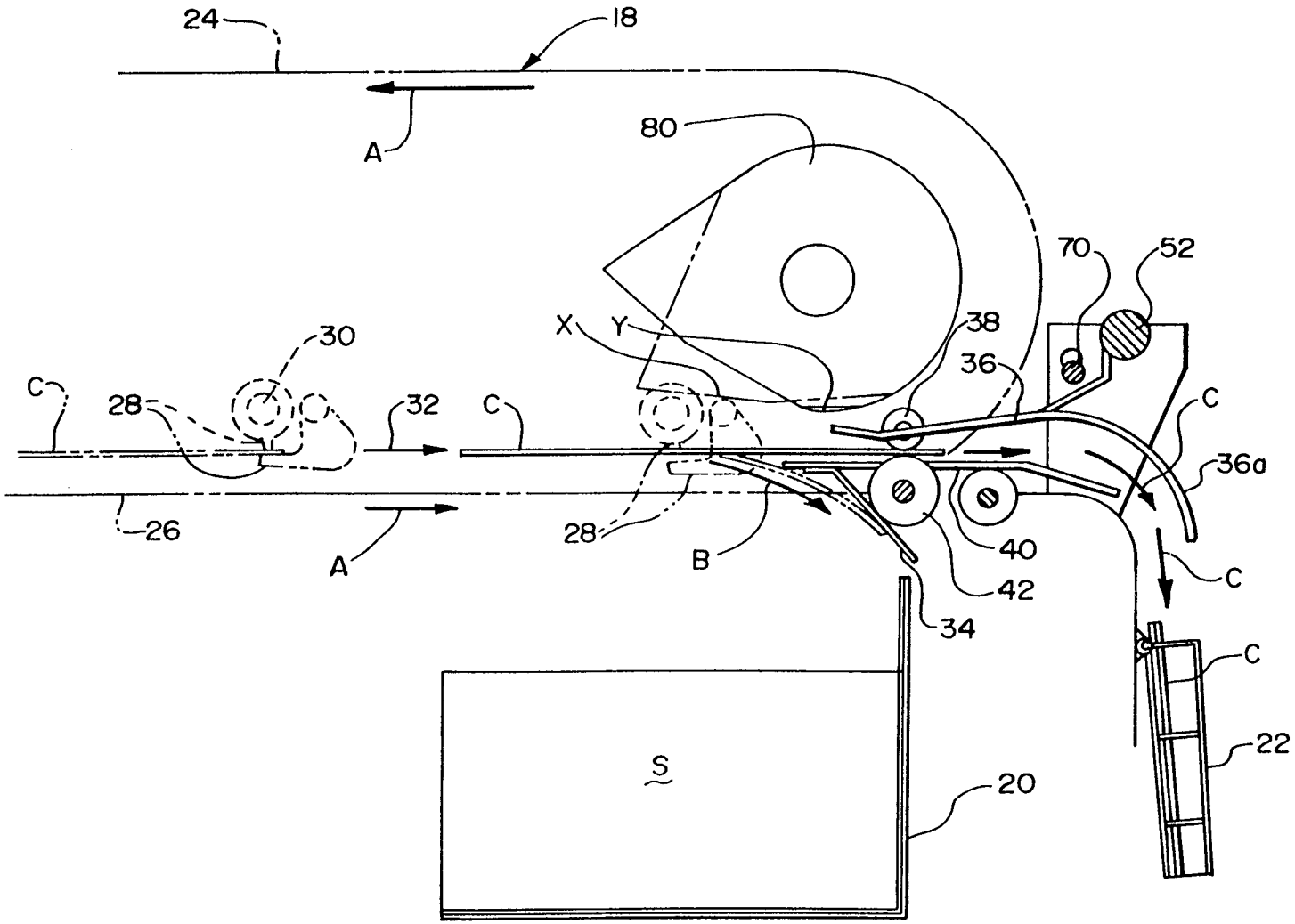
FIG. 2 is a somewhat schematic illustration of the components at the exit end of the machine for stacking copy sheets and for proofing selected sheets.

FIG. 2 is a somewhat schematic illustration of the major components at the exit end 14 (FIG. 1) of the machine for stripping copy sheets "C" off of a conveyor means, generally designated 18, and directing the sheets downwardly onto a stack "S" of sheets in a receiving tray 20. The proofing mechanism, described hereinafter, deflects the sheets to a proofing station, i.e., into a proofing tray 22.

More particularly, a chain delivery-type conveyor means includes an endless drive chain including an upper run 24 and a lower run 26 whereby the chain moves in the direction of arrows "A". As is known, a pair of such endless drive chains are mounted in parallel and spaced transversely at opposite sides of the paper path. Conventional gripper fingers 28 are mounted at spaced intervals on gripper bars 30 which are mounted transversely between the parallel chains and at spaced intervals longitudinally of the chains, as is known. As also is conventional, the gripper fingers grasp the sheets issuing from the machine off of an impression cylinder, described hereinafter, and move the copy sheets generally in a paper path as indicated by arrow 32. At an appropriate point along the path of travel of the sheets, shown in FIG. 2 as point "X", some form of tripping mechanism will open gripper fingers 28 whereby appropriate stripping means will strip the sheets from the chain delivery device and direct the sheets downwardly, as indicated by arrow B, onto stack "S" of sheets in receiving tray 20. In the illustrated embodiment, the stripping means are in the form of stripper fingers 34. In some machines, air jets are used as the stripping means to divert the sheets from the path into the receiving tray. Up to this point, the operation of the chain delivery device, stripping means, etc. is generally known in the art.

Figure 3:
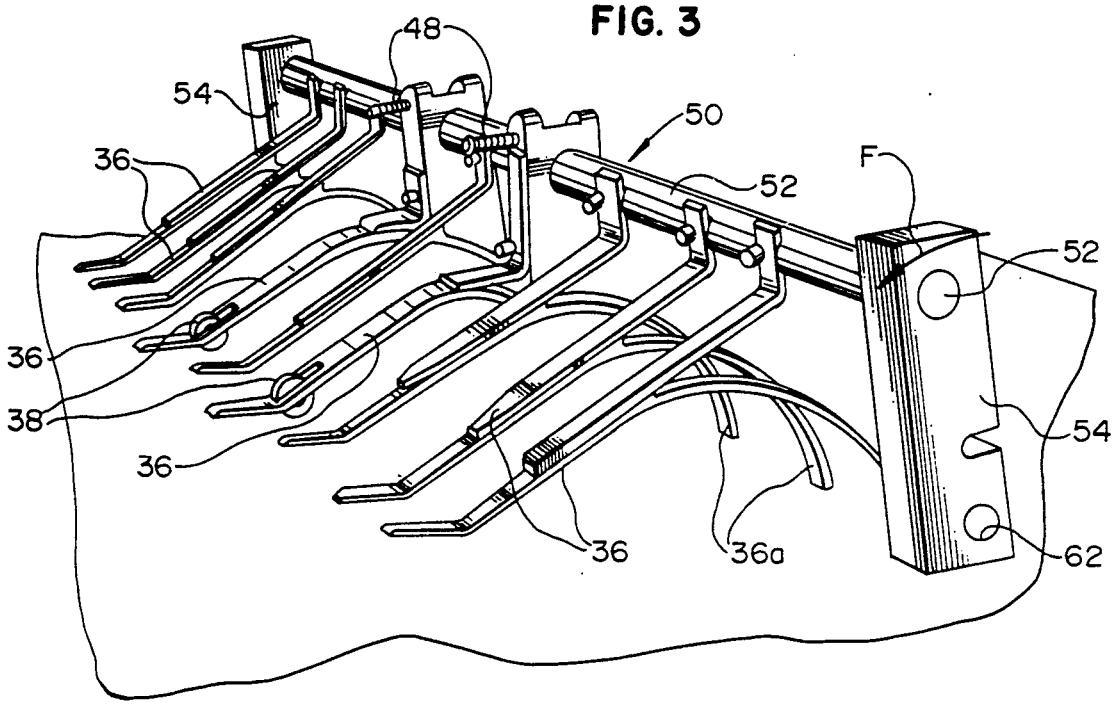
FIG. 3 is a perspective view of the deflecting finger assembly for the proof sheets.
Figure 5:
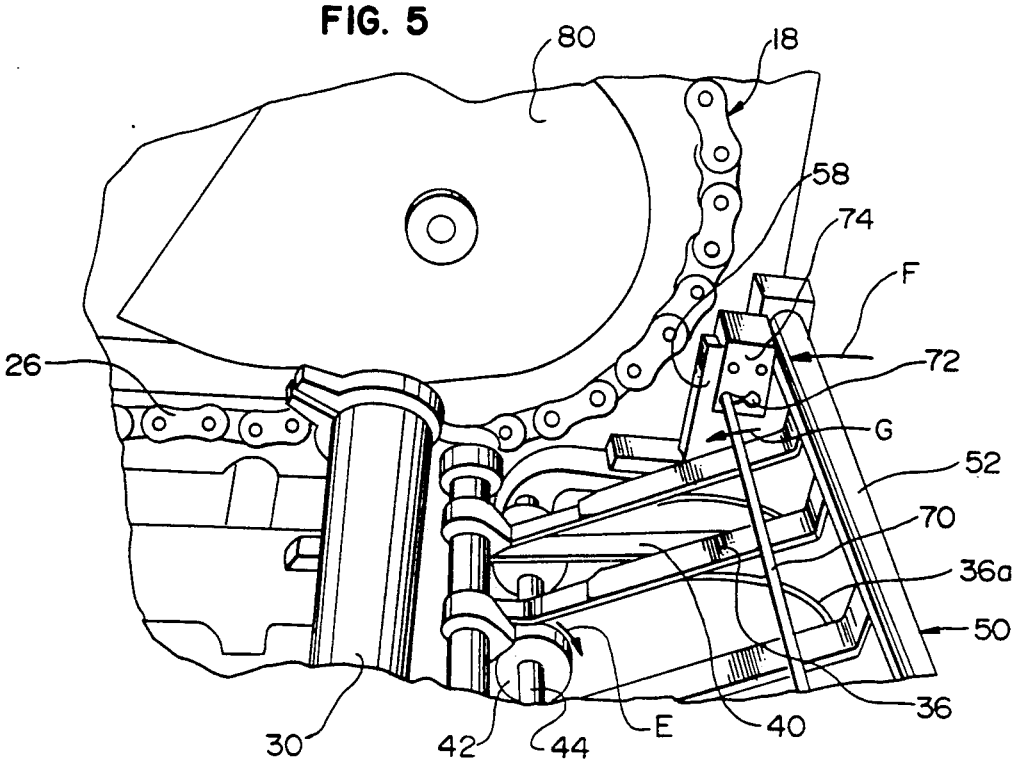
FIG. 5 is a fragmented perspective view of one end of the deflecting assembly, along with portions of the chain delivery means and tripping cam.
Figure 4:
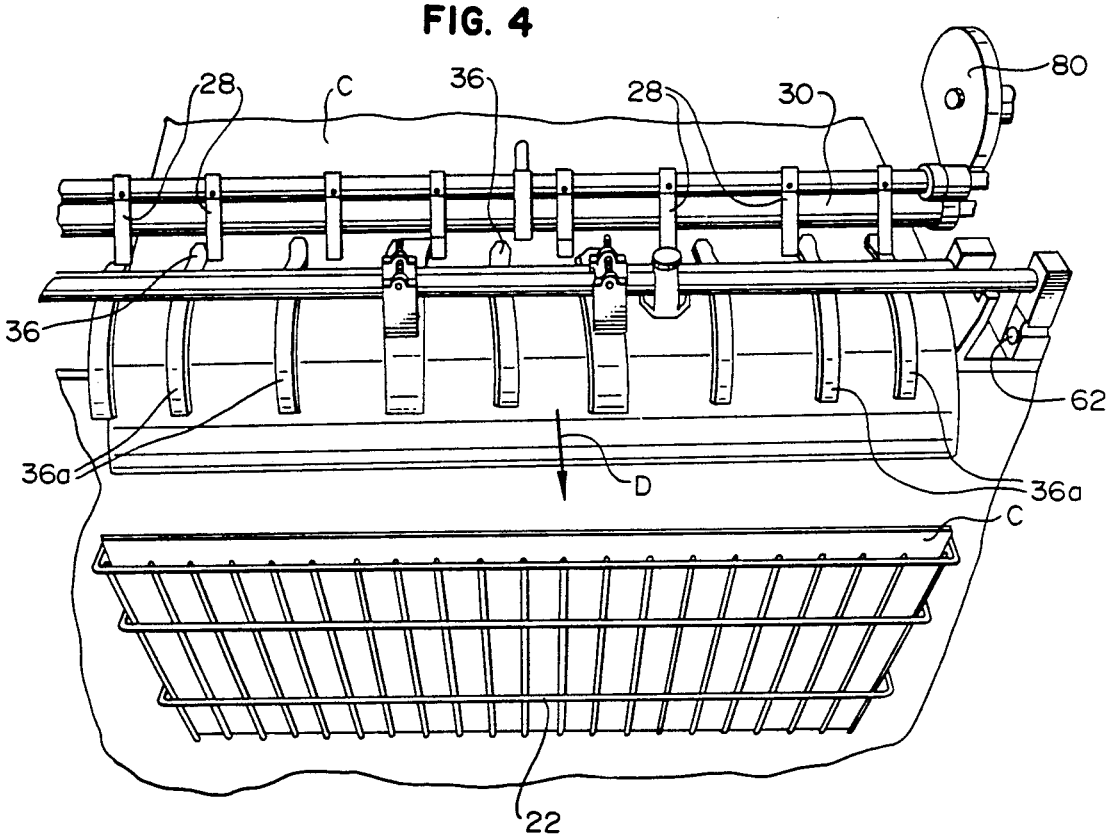
FIG. 4 is a perspective view of the assembly of FIG. 3, looking toward the rear thereof, and showing the proofing tray for receiving copy sheets.

The invention contemplates deflecting means spaced along path 32 from point "X" for deflecting a sheet from the conveyor means, in the direction of arrow "C" to proofing tray 22. More particularly, referring to FIGS. 3, 4, and 5 in conjunction with FIG. 2, the deflecting means include a plurality of deflecting fingers 36 having curved rear ends 36*a*, the curved rear ends being effective to curve or bend a sheet downwardly into proofing tray 22 as shown best by arrow "D" in FIG. 4. As seen in FIG. 3, two of the deflecting fingers have pressure rollers 38 for purposes described hereinafter. Guide fingers 40, as shown in FIGS. 2 and 5 (also see FIGS. 6 and 7) are located below deflecting fingers 36 but stop short (at their rear ends), of curve portions 36*a* of the deflecting fingers. An appropriately released copy sheet, as described hereinafter, passes between guide fingers 40 and deflecting fingers 36 (actually, above guide fingers 40 and below deflecting fingers 36), and then into proofing tray 22 as a result of curved finger portions 36*a*.

In order to facilitate deflection of a released sheet from the gripper fingers of the conveyor means into proofing tray 22, a plurality of rollers 42 (FIGS. 5 and 6) are fixed to a shaft 44 and appropriately continuously rotated by motor means 46 (FIG. 6) to provide a positive drive in the direction of arrows "E" toward the proofing station or tray. The two pressure rollers 38 shown in FIG. 3 on two of the deflecting fingers 36 form a nip with two of the driven rollers 42 to positively drive a sheet against curved finger portions 38 and into the proofing tray. To this end, the two deflecting fingers 36 which mount rollers 38 are spring loaded, as at 48 in FIG. 3.

In order to better illustrate the deflecting fingers, it should be noted that FIG. 3 shows a deflecting finger assembly, generally designated 50, which includes a transverse rod 52 fixed between a pair of end mounting blocks 54. The view of FIG. 3 has been reversed in relation to FIGS. 6 and 7 in order to give a full illustration of the deflecting finger arrangement. With this understanding, and referring to FIGS. 6 and 7, transverse rod 52 seats in a saddle 56 at the top of rigid frame members 58, and stub shafts (not shown) pass through holes 59 in frame blocks 60 (FIGS. 6 and 7) and through holes 62 in mounting blocks 54 (FIG. 3). Saddles 56 are slightly wider than the diameter of rod 52, whereby the entire deflecting finger assembly 50 can pivot about an axis defined by holes 59, 62 and the appropriate stub shafts extending therethrough. It can be understood when viewing the assembly shown in FIG. 3, that the deflecting fingers 36 cause the assembly to be "top heavy" whereby the assembly will lean in the direction of arrow "F" about the pivot defined by holes 62. Arrow "F" is shown in the opposite direction in FIG. 6. In other words, the entire gripper finger assembly leans forwardly relative to the machine, as can be seen in FIG. 5.

Figure 6:
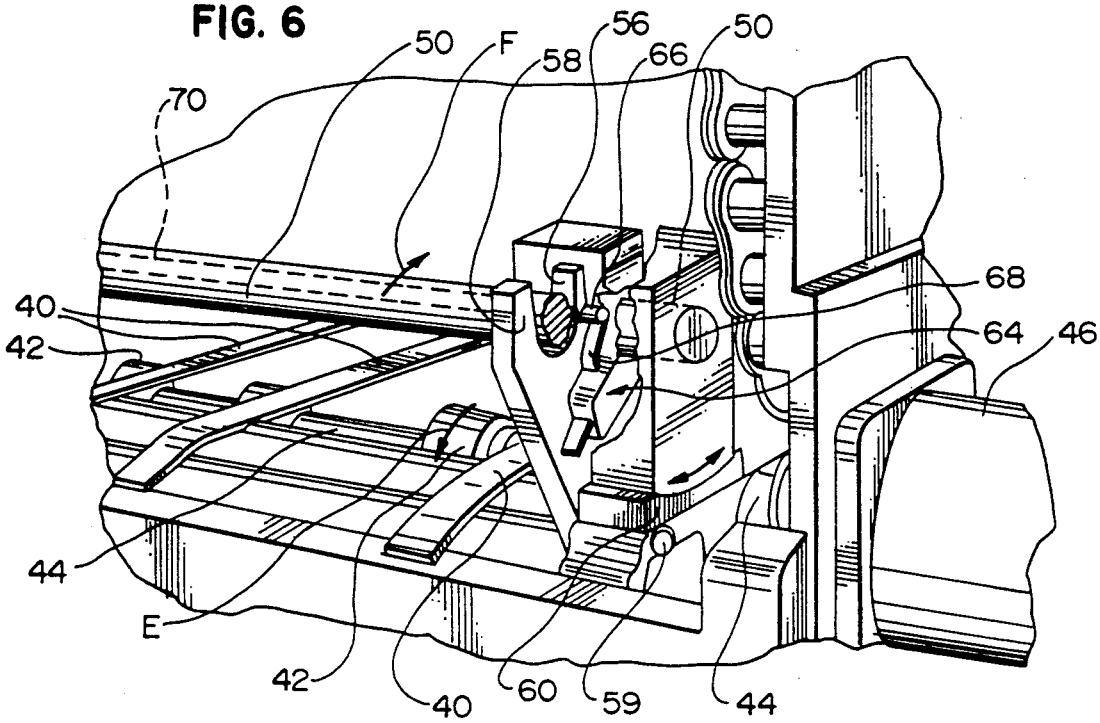
FIG. 6 is a fragmented perspective view looking at the back side of FIG. 5, with the deflecting finger assembly removed to facilitate the illustration.

FIG. 6 shows a micro-switch, generally designated 64, having a switch button 66 biased by a leaf spring switch actuator 68 opposite the "leaning direction" of deflecting finger assembly 50, i.e., opposite the direction of arrow "F" (FIG. 6). The first switch means (micro-switch 64) is appropriately connected to the main drive system of the machine and provides a safety feature should sheets become jammed between deflecting fingers 36 and guide fingers 40. The pressure of the jammed sheets will pivot the finger assembly opposite the direction of arrow "F" and rod 52 will move away from micro-switch button 66, whereupon leaf spring switch actuator 68 will trip the micro-switch to shut down the machine.

Figure 7:
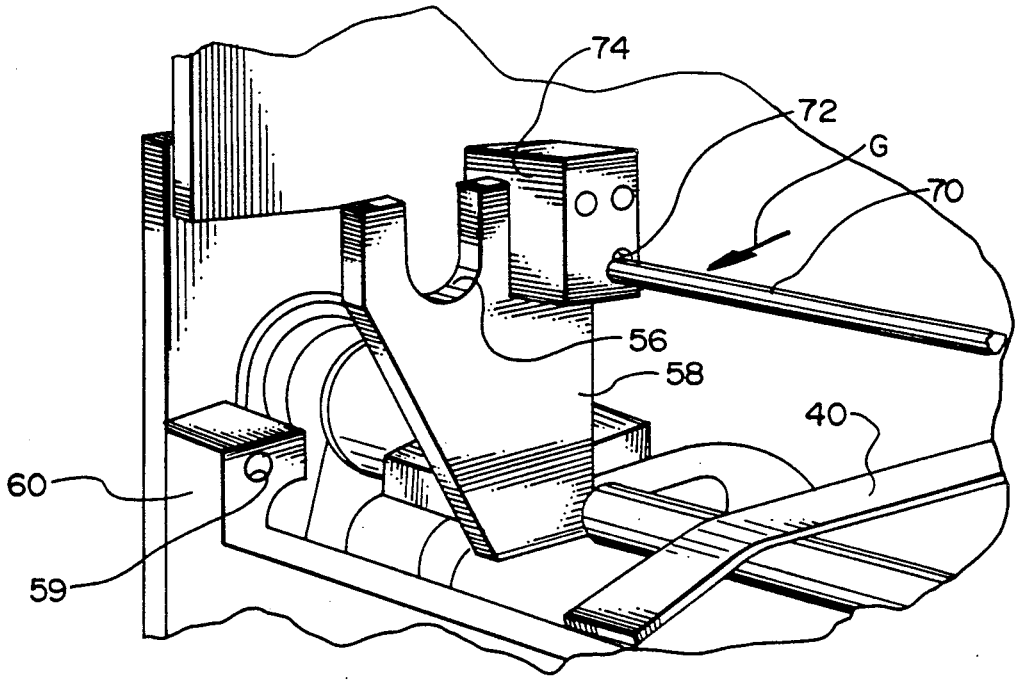
FIG. 7 is a fragmented perspective view of the opposite end of the machine from that shown in FIG. 6.
Figure 8:
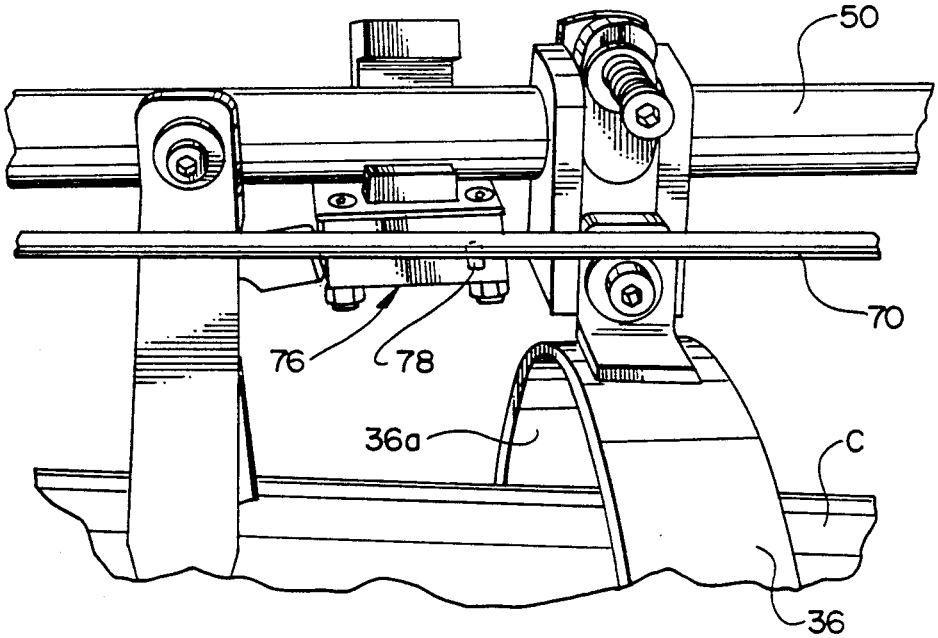
FIG. 8 is a fragmented perspective view illustrating the micro-switch means for the stray sheet tripping rod.

Another safety feature is shown in FIGS. 5, 7 and 8 and includes a small diameter safety rod 70 extending transversely across the top of deflecting finger assembly 50 (see FIG. 5) and into enlarged apertures 72 (FIGS. 5 and 7) in blocks 74 fixed to frame members 58. Springs (not shown) in blocks 74 bias safety rod 70 forwardly in the direction of arrow "G". As seen in FIG. 8, safety rod 70 passes across a second switch means, namely microswitch 76, which includes a switch button 78 located immediately behind bar 70. This provides a safety feature should a sheet "miss" the nip between deflecting fingers 36 and guide fingers 40 (or between upper pressure rollers 38 and lower driven rollers 42). Such a stray sheet sometimes is termed a "wild" sheet and, in essence, flies out of the normal sheet path because of a variety of reasons such as momentary air currents. Such a stray sheet can jam the machine severely and cause all kinds of bending, breaking or other damage to the machine components, such as the stripper fingers, deflector fingers, guide fingers, bars, shafts, etc. Should such a stray sheet miss the nip between the deflecting fingers and the guide fingers and become jammed against safety rod 70, the rod will move away from switch button 78 and trip the switch to shut down the machine.

Referring to FIGS. 9 and 10 in conjunction with FIG. 2, generally, tripping means in the form of a cam plate 80 is provided adjacent paper path 32 (FIG. 1) and in the path of gripper fingers 28 on the lower run 26 of conveyor means or chain 18. Specifically, as stated above, point "X" (FIG. 2) represents the point at which it is necessary to trip or open gripper fingers 28 in order that the copy sheets be stripped by stripper fingers 38 for delivery onto stack "S" in receiving tray 20. However, when it is desired to eject or deflect a sheet for proofing purposes, the sheet must bypass point "X" and the gripper fingers must be released at a point "Y" further rearwardly of the path so that the sheet can be deflected into proofing tray 22 as described above.

To this end, and referring to FIGS. 9 and 10, tripping cam 80 is rotatably mounted on the machine by a stub shaft 82 which is fixed to one end of a lever arm 84. The opposite end of the lever arm is connected to a piston shaft 86 of a piston-and-cylinder device 88. Therefore, the piston-and-cylinder device moves lever arm 84 in the direction of double-headed arrow "H" which, in turn, effects rotation of tripping cam 80 about shaft 82. Gripper fingers 28 are shown somewhat schematically in FIGS. 9 and 10 because they are widely known in the art, including some form of tripping mechanism for engaging a cam follower 90 which opens the gripper fingers, as at 92, to release the copy sheet.

FIG. 9 shows tripping cam 80 in a position where a first peripheral cam portion or lobe 94 is located in the path of travel of cam follower 94 for tripping or opening the gripper fingers. This represents the first point "X" in FIG. 2.

FIG. 10 shows piston-and-cylinder device 88 having rotated tripping cam 80 such that lobe 94 has been moved upwardly in the direction of arrow "I" out of the path of movement of cam follower 90 on the gripping fingers. Therefore, it can be understood that the gripping fingers will move past point "X" in FIG. 2. However, that rotation of tripping cam 80 causes a second portion 96 of the cam plate to be moved downwardly in the direction of arrow "J" (FIG. 10) into the path of travel of cam follower 90. The second peripheral cam portion 96 is located spaced from and down line of first peripheral cam portion 94 to define point "Y" in FIG. 2 at which the gripper fingers are opened to release the sheet for deflection into proofing tray 22, as described in detail above.

As stated heretofore, and referring to FIG. 11, the proofing system of the invention is particularly applicable for machines which include a finishing station, particularly a machine which is capable of sequentially numbering the copy sheets as they issue from the machine. FIG. 11 shows an impression cylinder 98 of the machine, along with a numbering drum 100 which includes one or more numbering heads, generally designated 102. The numbering heads are standard assemblies and include an indexing lever 104 which, when tripped or actuated, indexes the numbering head to the next sequential number. Some form of tripping cam 106 is located on the machine in the path of travel of the indexing levers 104 to momentarily move the levers and index the numbering head to the next number. This general arrangement is known in the art. However, the invention contemplates the provision of interruption means for preventing operation of the indexing of the numbering head so that a given sheet will not be sequentially numbered and such that the given sheet can be selectively deflected to the proofing station as initially effected by rotation of tripping cam 80 (FIGS. 9 and 10).

More particularly, cam 106 is fixed to a shaft 108 which, in turn, is fixed to one end of a lever arm 110. The opposite end of lever arm 110 is connected to a piston rod 112 of a second piston-and-cylinder device 114. Therefore, upon actuation of the piston-and-cylinder device to move lever arm 110 in the direction of arrow "K", cam 106 will be moved to the phantom position shown in FIG. 11 and out of the path of rotation of indexing lever 104. Consequently, the sequential numbering of the sheets are interrupted and the numbering head simply repeats the previous number for one or more copy sheets depending upon how many sheets are to be deflected into proofing tray 22.

Appropriate control means are provided for actuating piston-and-cylinder devices 88 and 114. A variety of control means can be utilized, ranging from manual switches whereby an operator first can actuate piston-and-cylinder device 114 to interrupt the numbering cycle and immediately thereafter actuate piston-and-cylinder device 88 to deflect the copy sheet which is not sequentially numbered However, in high speed duplicating machines, the control means can be incorporated in the microprocessor of the machine which controls the myriad of timing cycles for the feeding system, registration system, roller rotation synchronization, sheet transfer mechanisms, etc.

FIG. 11 schematically shows a microprocessor 116 coupled by a line 118 to a solenoid 120 for controlling piston-and-cylinder device 114. A line 122 (which is picked up in FIG. 9) leads to a solenoid 124 for actuating piston-and-cylinder device 88 for tripping cam 80. A time delay "T" is built into the microprocessor so that piston-and-cylinder device 114 is effective to interrupt the numbering system before piston-and-cylinder device 88 is effective to deflect a sheet into the proofing tray. This delay is necessary because of the distance the sheet travels off of impression cylinder 98 along conveyor means 18 to the rear deflecting area of the machine. Of course, as with all of the other functions of the machine, this time delay is variable depending upon the size of sheets being run through the machine. For instance, such microprocessors must be set to correlate the feeding station with other transfer mechanisms throughout the machine for longer and shorter sheet sizes.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing, duplicating and like machine wherein sheets are delivered seriatim by conveyor means from a printing couple in a path over a receiving tray whereat the sheets drop onto a stack of sheets in the tray, with releasable sheet gripping means on and movable with the conveyor means for gripping and selectively releasing the sheets, and stripping means located along the path of movement of the conveyor means for stripping each released sheet from the conveyor means and directing the sheet into the tray, a sheet proofing mechanism, comprising:

deflecting means along said path spaced from the stripping means for deflecting a released sheet from the conveyor means to a proofing station, including at least one deflecting finger movable mounted on the machine for movement in response to jamming of multiple sheets thereagainst;

first switch means operatively associated with the deflecting finger for actuation in response to movement of the deflecting finger to deactivate the machine;

a safety rod movably mounted on the machine laterally across said path above said deflecting means for movement in response to a stray sheet jamming against the rod; and second switch means operatively associated with the safety rod for actuation in response to movement of the safety rod to deactivate the machine.

2. The sheet proofing mechanism of claim 1 including tripping means at a predetermined location along said path remote from the printing couple and operatively associated with the gripping means for selectively performing one of the dual functions of engaging the gripping means at a first point along the path of movement of the conveyor means to release a sheet from the gripping means and allow the stripping means to strip the released sheet from the conveyor means and direct the sheet into the tray and engaging the gripping means at a second point along the path of movement of the conveyor means to release a sheet from the gripping means and allow the deflecting means to deflect the released sheet to the proofing station.

3. The sheet proofing mechanism of claim 2 wherein said machine includes a numbering head for sequentially numbering the sheets, with indexing means for indexing the numbering head, and the proofing mechanism includes interruption means for preventing operation of the indexing means whereby a given sheet will not be sequentially numbered and such that the given sheet can be selectively deflected to the proofing station by the tripping means without interrupting the remaining order of sequential numbering.

* * * * *